US005699763A

United States Patent [19]

Phillips et al.

[11] Patent Number: 5,699,763

[45] Date of Patent: Dec. 23, 1997

[54] AIR INTAKE SYSTEM FOR A MARINE ENGINE

[75] Inventors: George E. Phillips, Oshkosh; Wayne M. Jaszewski, Jackson; John M. Griffiths, Fond du Lac; Keith W. Gessner, Kewaskum, all of Wis.

[73] Assignee: Brunswick Corporation, Lake Forest, Ill.

[21] Appl. No.: 733,002

[22] Filed: Oct. 16, 1996

[51] Int. Cl.[6] ..... F02M 35/10

[52] U.S. Cl. ..... 123/184.21; 123/184.46

[58] Field of Search ..... 123/184.21, 184.23, 123/184.38, 184.46, 195 P, 184.39, 184.32

[56] References Cited

U.S. PATENT DOCUMENTS

| | | | |
|---|---|---|---|
| 4,440,697 | 4/1984 | Sakurai | 123/184.38 |
| 4,784,090 | 11/1988 | Sougawa | 123/184.23 |
| 4,846,300 | 7/1989 | Boda | 181/229 |
| 4,917,053 | 4/1990 | Okazaki et al. | 123/184.39 |
| 4,967,704 | 11/1990 | Imaeda | 123/184.23 |
| 4,993,369 | 2/1991 | Breckenfeld et al. | 123/184.23 |
| 5,309,877 | 5/1994 | Shigedomi et al. | 123/195 P |
| 5,596,962 | 1/1997 | Tsunoda et al. | 123/184.39 |
| 5,613,470 | 3/1997 | Shiomi et al. | 123/195 P |

*Primary Examiner*—David A. Okonsky

*Attorney, Agent, or Firm*—Andrus, Sceales, Starke & Sawall

[57] ABSTRACT

An air intake box for a four-stroke marine engine. The air box is generally U-shaped in configuration, including a lower section that is connected to the carburetor throat. The lower section extends forwardly from the carburetor and merges into an upper section via a reverse bend. The upper section extends rearwardly above the carburetor and terminates in a distal inlet end that is located at the rear of the engine. The air box reduces air intake noise, and results in cooler air being supplied to the engine, which enhances combustion.

12 Claims, 1 Drawing Sheet

FIG. 1
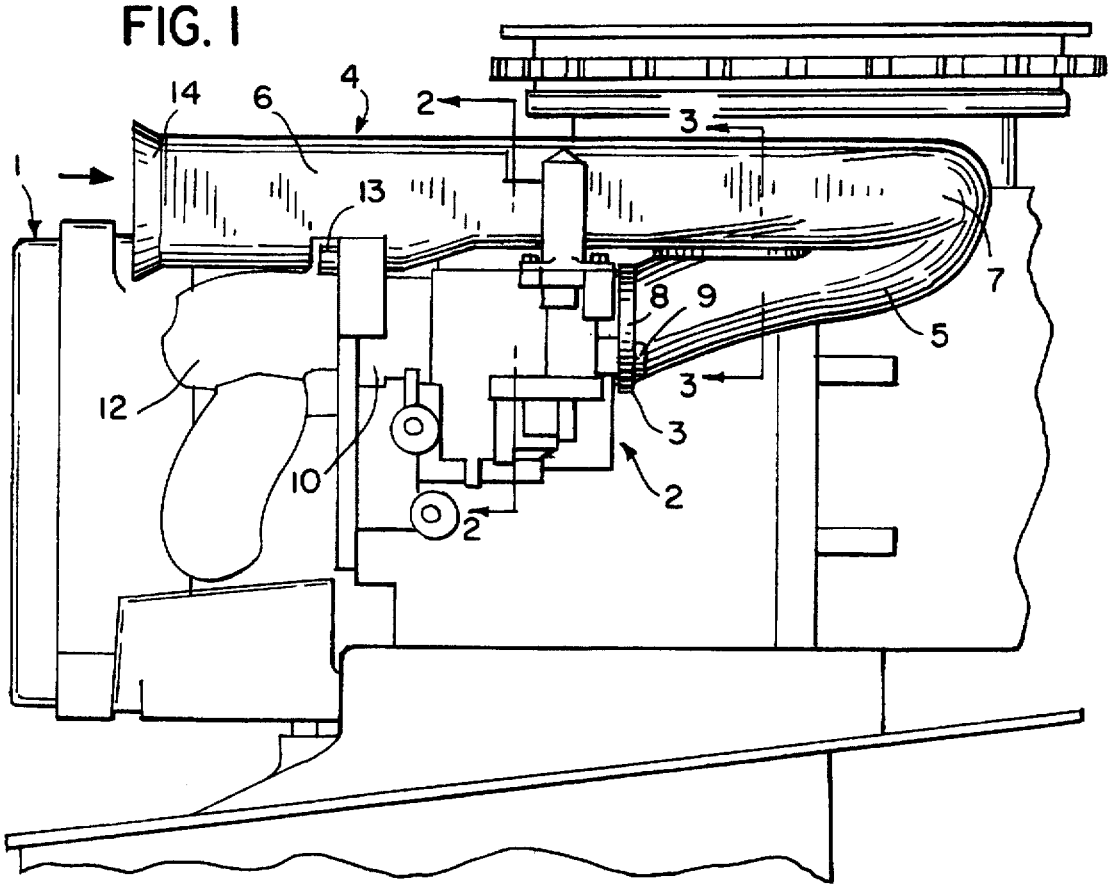
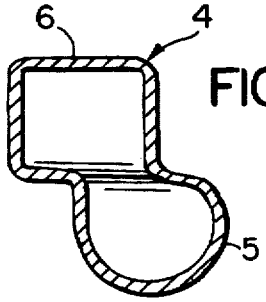
FIG. 3
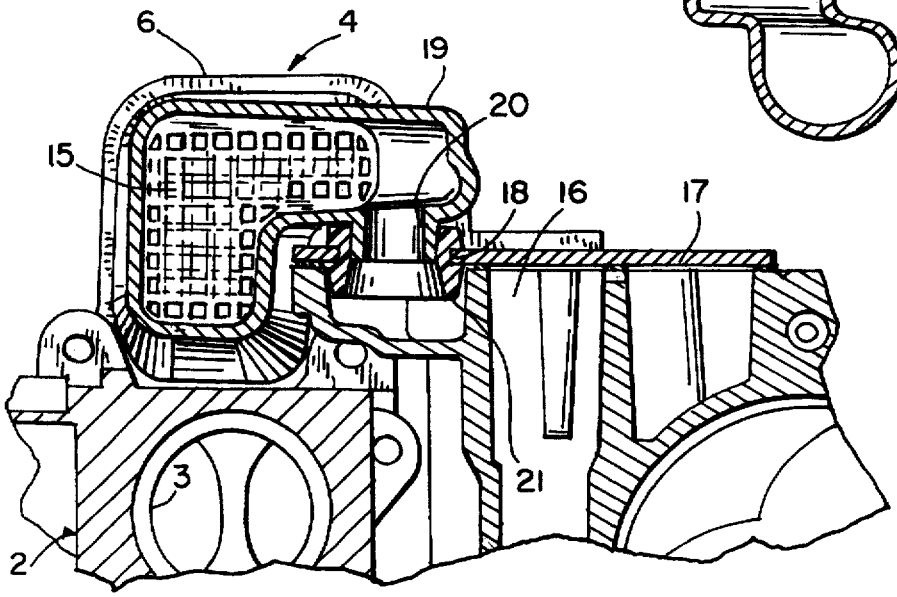
FIG. 2

AIR INTAKE SYSTEM FOR A MARINE ENGINE

CROSS-REFERENCE TO RELATED APPLICATION

Not Applicable

STATEMENT REGARDING FEDERALLY SPONSORED RESEARCH OR DEVELOPMENT

Not Applicable

BACKGROUND OF THE INVENTION

In a marine outboard engine, an air box is typically mounted on the carburetor for directing air into the carburetor and aid in silencing engine noise emitted through the carburetor throat. The carburetor throat normally faces forwardly of the engine, and therefore noise created by the air intake system is transmitted forwardly toward the operator in the boat.

It is recognized that cooler combustion air enhances engine performance. In the typical air intake system as used with an outboard engine, the combustion air is drawn into the cowl intake that is typically located at the top rear portion of the cowl and the air then travels forwardly across the engine to the air box that is connected to the carburetor. Thus, the air being drawn to the carburetor is heated as it passes along the engine, reducing performance of the engine.

SUMMARY OF THE INVENTION

The invention is directed to an improved air intake box for the carburetor of a four stroke marine engine that not only reduces noise emitted from the air intake system, but also results in cooler air being drawn to the carburetor which is beneficial to performance of the engine.

In accordance with a preferred embodiment of the invention, the air intake box is generally U-shaped, including a lower section and an upper section which are connected by a reverse bend. The free or distal end of the lower section of the air box is connected to the throat of the carburetor, and the lower section extends forwardly from the carburetor and merges via the reverse bend into the upper section which is generally parallel to the lower section and extends above the carburetor. The distal or rear end of the upper section is located adjacent the rear of the engine a substantial distance to the rear of the carburetor.

With this construction, combustion air is drawn into the upper cowl intake at the rear of the engine, and then passes into the rear end of the air box and hence to the carburetor. As the inlet to the air box faces to the rear and is located at the rear of the engine, air intake noise is directed toward the rear of the engine away from the operator.

As a further advantage, the inlet to the air box is located in proximate relation to the upper cowl air intake opening. This results in cooler air being drawn to the carburetor, which enhances performance of the engine.

As a further feature of the invention, the upper section of the air box can be formed with a lateral enlargement, and the enlarged area is provided with a downwardly extending nipple that is connected to the breather chamber of the engine block. With this arrangement, oil vapor from the crankcase will be drawn into the upper section of the air box and then to the carburetor. This construction eliminates the normal crankcase breather/vent hose that is typically used in a four stroke engine, along with the fittings and clamps that are necessary.

Other objects and advantages will appear during the course of the following description.

BRIEF DESCRIPTION OF THE SEVERAL VIEWS OF THE DRAWING

The drawings illustrate the best mode presently contemplated of carrying out the invention.

In the drawings:

FIG. 1 is a side elevation of a typical four stroke marine engine incorporating the air intake system of the invention;

FIG. 2 is a section taken along line 2—2 of FIG. 1; and

FIG. 3 is a section taken along line 3—3 of FIG. 1.

DETAILED DESCRIPTION OF THE INVENTION

FIG. 1 illustrates a typical four stroke outboard marine engine incorporating the improved carburetor air intake system of the invention.

The engine includes an engine block 1 formed of an aluminum alloy or the like, which defines a plurality of cylinder bores, not shown. A carburetor 2, of conventional construction, is mounted on block 1 and acts to provide a combustible mixture of air and fuel vapor to the cylinders of the engine block.

Carburetor 2 includes an intake throat 3, and air is drawn into throat 3 through an air box 4 which has a generally U-shaped configuration.

Air box 4 includes a lower section 5 and an upper section 6 which is connected to the lower section by a reverse bend 7 that is located forwardly of carburetor 2. As viewed in FIG. 1, the forward end of the engine, which faces the bow of the boat, is located to the right, while the rear end of the engine is located to the left.

The end of lower section 5 is provided with an outwardly extending peripheral flange 8 which is connected to carburetor 2 by a pair of bolts 9 that extend through openings in the carburetor and are threaded into a manifold diffuser 10 which is mounted on the cylinder head which in turn is mounted to the engine block 1. Air box 4, carburetor 2, and manifold diffuser 10 comprise an integral unit, and this unit is connected to the cylinder head 12 by bolts 13.

Lower section 5 of air box 4 is generally circular in cross section, as best shown in FIG. 3, while the upper section 6 has a generally rectangular section.

The distal or rear end 14 of upper section 6 of air box 4, through which air is drawn into the air box, faces rearwardly and is flared outwardly. A screen 15 is located across end 14 to prevent debris from entering the air box.

While the drawings show the inlet 14 of the air box 4 being generally parallel to the fore and aft axis of the engine, it is contemplated that the inlet can be located at an angle to the fore and aft axis. However, it is preferred that the inlet opening not face at an upward angle toward the upper cowl air intake opening in order to prevent water, which may splash through the air intake opening in the cowl, from entering the air box.

Air box 4 is preferably molded from a composite material, such as a thermosetting or thermoplastic resin. The inner surface of air box 4 is relatively smooth and does not contain any baffles or ribs which would impede the flow of air through the air box to carburetor 2.

As the air inlet end 14 is located at the rear of the engine, and faces away from the operator in the boat, the air intake noise, as well as engine noise emitted through the carburetor, is directed toward the rear of the engine away from the operator. Further, the composite material of the air box serves to muffle the noise, with the result that the noise level in the boat is reduced.

As a further advantage, the air being drawn through the air box to the carburetor not in direct heat transfer relation with the engine, resulting in cooler air being drawn to the carburetor, and thus enhancing performance of the engine.

As a further feature of the invention, air box 4 is connected directly to the breather chamber 16 of the engine block 1. As shown in FIG. 2, the upper open end of breather chamber 16 is enclosed by a cover 17 having an opening 18. Upper section 6 air box 4 is formed with a lateral enlargement or protrusion 19 having a downwardly extending nipple 20 that communicates with the opening 18 in breather cover 17. Nipple 20 is sealed to the opening by a resilient grommet 21 as shown in FIG. 2.

With this construction, vapor from the crankcase is allowed to flow from the breather chamber 16 to the air box 4 and then to the carburetor 2. This arrangement eliminates the crankcase breather/vent hose that is commonly used with four-stroke marine engines, as well as eliminating the fittings and clamps necessary to connect the hose to the engine.

While the above description has shown the invention at used with a carburetion system, it is contemplated that the invention can also be incorporated with the air inlet opening of a fuel injection system.

The drawings and description have shown the air intake system used with a single carburetor. However, the system can also be used with multiple carburetors in which air enters the rear facing inlet of the air box and is distributed through a plenum or header to the throats of the carburetors.

We claim:

1. In a four stroke outboard marine engine for a boat, a cylinder block having at least one cylinder bore, said engine block having a forward end facing toward a bow of the boat and having a rear end, a fuel delivery unit mounted on the engine block for supplying a combustible mixture of fuel and air to the cylinder bore, and having an air intake opening facing in a forward direction, and an air intake box having a first end facing in a rearward direction and disposed in communication with said intake opening, said air intake box also having a second end facing in a rearward direction and located to the rear of the fuel delivery unit, whereby air from the rear portion of the engine is drawn into said second end and passes through said air box and is discharged through said first end to said fuel delivery unit.

2. The engine of claim 1, wherein said air box includes a first section extending forwardly from said first end, and a second section located above said first section, said air box also including a reverse bend section connecting said first and second sections.

3. The engine of claim 1, wherein said second end is located at the rear of said engine block.

4. The engine of claim 1, wherein the internal surface of said air box is smooth and substantially free of baffles.

5. The engine of claim 1, wherein said engine block includes a breather chamber connected to a crankcase of the engine, and conduit means connecting said breather chamber with the interior of said air box.

6. The engine of claim 2, wherein said second section is disposed above said fuel delivery unit.

7. The engine of claim 2, wherein said engine block includes a breather chamber connected to a crankcase of the engine, and conduit means connecting the second section of said air box to said breather chamber.

8. The engine of claim 7, wherein said conduit means comprises a tubular nipple extending outwardly from said second section, and sealing means for connecting said nipple in sealed relation to said breather chamber.

9. In a four-stroke outboard marine engine for a boat, an engine block having a plurality of cylinders, said engine block having a forward end facing the bow of the boat and having a rear end, a carburetor mounted on the engine block for supplying a combustible mixture of fuel and air to said cylinders, said carburetor having an air intake opening facing in a forward direction, an air intake box for supplying air to the intake opening of the carburetor, said air box including a first section having a first rearward facing end connected to said air intake opening and further including a second section located generally parallel to said first section and terminating in a second rearward facing end, said air box also including a reverse bend section connecting said first section and said second section, said second end located adjacent the rear of said engine, whereby air is drawn into said second end and flows through said air box and is discharged through said first end to said carburetor.

10. The engine of claim 9 wherein said air box is composed of a plastic material.

11. The engine of claim 9, wherein said first section extends upwardly at an acute angle to the horizontal from the carburetor, and said second section extends above the carburetor.

12. The engine of claim 9, wherein said second end is located rearwardly of said first end.

* * * * *